US005701769A

United States Patent [19]

Hall

[11] Patent Number: 5,701,769

[45] Date of Patent: Dec. 30, 1997

[54] GRASPING APPARATUS AND METHOD

[76] Inventor: Jeffrey D. Hall, P.O. Box 2753, Augusta, Ga. 30914

[21] Appl. No.: 656,429

[22] Filed: May 30, 1996

[51] Int. Cl.[6] ..... E05B 73/00

[52] U.S. Cl. ..... 70/19; 70/14; 70/58

[58] Field of Search ..... 70/18, 17, 19, 70/27, 29, 62, 198, 311, 312

[56] References Cited

U.S. PATENT DOCUMENTS

| | | | |
|---|---|---|---|
| 380,961 | 4/1888 | Waine | 70/18 |
| 615,659 | 12/1898 | Blyer | 70/62 |
| 636,439 | 11/1899 | Maltby | 70/17 |
| 691,941 | 1/1902 | Headson | 70/17 |
| 832,143 | 10/1906 | Mercer | 70/17 |
| 885,811 | 4/1908 | Ward | 70/17 |
| 970,856 | 9/1910 | Simisky | 70/18 |
| 1,098,103 | 5/1914 | Freschl | 70/19 |
| 1,197,549 | 9/1916 | Russell | 70/17 |
| 1,395,380 | 11/1921 | Kuc | 70/18 |
| 1,395,970 | 11/1921 | Nidermaier | 70/18 |
| 1,409,106 | 3/1922 | Hess | 70/19 |
| 1,505,660 | 8/1924 | Moersch | 70/17 |
| 1,570,458 | 1/1926 | Cederlof | 70/17 |
| 1,719,698 | 7/1929 | Gross | 70/17 |
| 1,806,660 | 5/1931 | Backus | 70/62 |
| 1,819,813 | 8/1931 | Ellenberger | 70/19 |
| 1,950,757 | 3/1934 | Smith-Stange | 70/17 |
| 1,998,050 | 4/1935 | Gasdorf | 70/232 |
| 2,066,654 | 1/1937 | Smith-Stange | 70/17 |
| 2,383,077 | 8/1945 | Powell | 70/17 |
| 3,264,851 | 8/1966 | Kimball | 70/58 |
| 3,512,380 | 5/1970 | Winter . | |
| 3,953,990 | 5/1976 | Nagel | 70/18 |
| 4,267,715 | 5/1981 | Aylesworth | 70/58 |
| 4,682,481 | 7/1987 | Dimmick et al. | 70/14 |
| 4,805,426 | 2/1989 | Dimmick et al. | 70/14 |
| 4,865,204 | 9/1989 | Vance | 206/625 |
| 4,995,250 | 2/1991 | Chiou | 70/238 |
| 5,247,815 | 9/1993 | Caldwell | 70/19 |

FOREIGN PATENT DOCUMENTS

| | | | |
|---|---|---|---|
| 248229 | 6/1912 | Germany | 70/17 |
| 317858 | 1/1920 | Germany | 70/17 |
| 335507 | 4/1921 | Germany | 70/226 |
| 539918 | 12/1931 | Germany | 70/62 |

*Primary Examiner*—Rodney M. Lindsey
*Assistant Examiner*—Tuyet-Philong Pham
*Attorney, Agent, or Firm*—Hardaway Law Firm, PA

[57] ABSTRACT

A grasping apparatus and method wherein the apparatus includes a sleeve with a shaft therein and a clamping member on one or both ends of the sleeve for opening and closing. A locking member is positioned on the sleeve for locking the sleeve to the shaft. When unlocked, movement of the shaft within the sleeve or the sleeve along the shaft actuates movement of the clamping member.

33 Claims, 4 Drawing Sheets

GRASPING APPARATUS AND METHOD

FIELD OF THE INVENTION

This invention relates generally to the art of grasping apparatuses, and more particularly, to grasping apparatuses that are versatile, effective, convenient and simple to use.

PRIOR ART

Various apparatuses and methods exist in the prior art for grasping or locking.

U.S. Pat. No. 3,953,990 discloses a locking device comprising a chain having spring-loaded spring fingers at one or both ends for snapping onto a link of the chain or onto a ring provided for that purpose. The spring fingers have a minute space between them to permit insertion of a pin therebetween to lock the pin between the spring fingers whereupon a key must be used to rotate a cam which forces the spring fingers apart releasing the pin. In another embodiment, hook-shaped members or tongs are used in place of the spring fingers and the tongs are joined at a pivot and each has a tab which can be pressed to separate the ends of the tongs.

U.S. Pat. No. 3,512,380 discloses a shaft lock comprising a threaded shaft carried in a threaded bore and adapted to be turned therein against other members to effectuate a locking action. The threaded bore is formed within a cylindrical socket adapted to receive a cylindrical key to fit on the end of the shaft.

U.S. Pat. No. 5,247,815 discloses a tire clamp for preventing theft of a vehicle wherein the tire clamp comprises two jaws that slide toward each other to close on a tire. The jaws are prevented from sliding apart unless released with a key.

Despite the existence of these locking apparatuses, room for improvement exists within the art.

SUMMARY OF THE INVENTION

It is therefore an object of this invention to provide a novel grasping apparatus and method.

It is another object of this invention to provide a grasping apparatus and method capable of grasping and securing a variety of objects to themselves or other objects.

It is a further object of this invention to provide a grasping apparatus and method which does not require the use of chains or cables.

It is still a further object of this invention to provide a gasping apparatus and method which can be simply and conveniently used with minimal effort.

It is still a further object of this invention to provide a grasping apparatus and method that can be fixed to a stationary or base object such as walls and can be used to grasp and lock objects to the same.

It is still a further object of this invention to provide a grasping apparatus which can be used to grasp and lock two objects together.

These as well as other objects are accomplished by a grasping apparatus comprising a sleeve with a shaft therein and a clamping member on the sleeve for opening and closing, whereby slidable movement of the sleeve along the shaft, of the shaft within the sleeve, or a combination of both such movements opens and closes the clamping member.

DETAILED DESCRIPTION

It has been found in accordance with this invention that a novel grasping apparatus and method can be provided that can be simply and conveniently used with minimal effort and which can secure a variety of objects, either to themselves or to other objects. It has also been found that a grasping apparatus and method can be provided which does not utilize chains or cables, thereby promoting ease of use. The gasping apparatus and method according to this invention can be fixed or secured to a stationary or base object, such as a wall, a bicycle frame, or the side of a pick-up track, in order to secure other objects to the stationary or base object.

Figure 1:
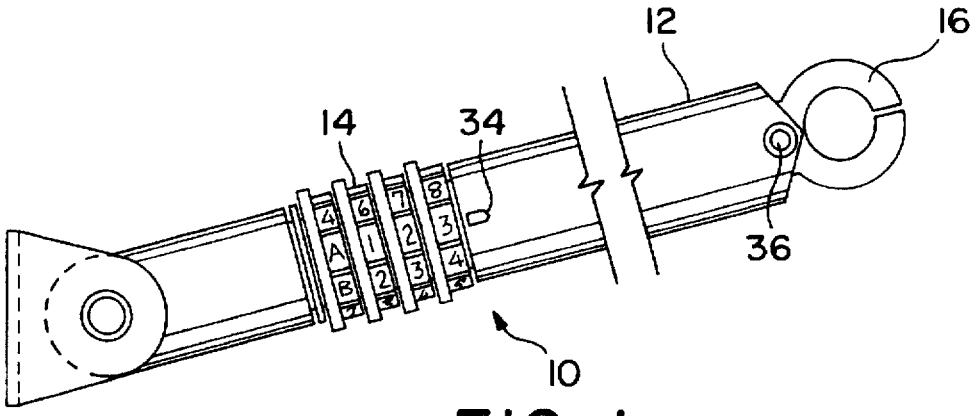
FIG. 1 of the drawings is an elevation view of a grasping apparatus according to this invention.

FIG. 1 of the drawings illustrates one embodiment of the grasping apparatus according to this invention. Grasping apparatus 10 is illustrated and comprises a sleeve 12 which is preferably cylindrical in shape and a locking member, illustrated in the preferred embodiment as combination lock 14, is attached to sleeve 12. A clamping member 16 is shown attached to sleeve 12 and is designed for opening and closing as discussed further below.

Figure 2:
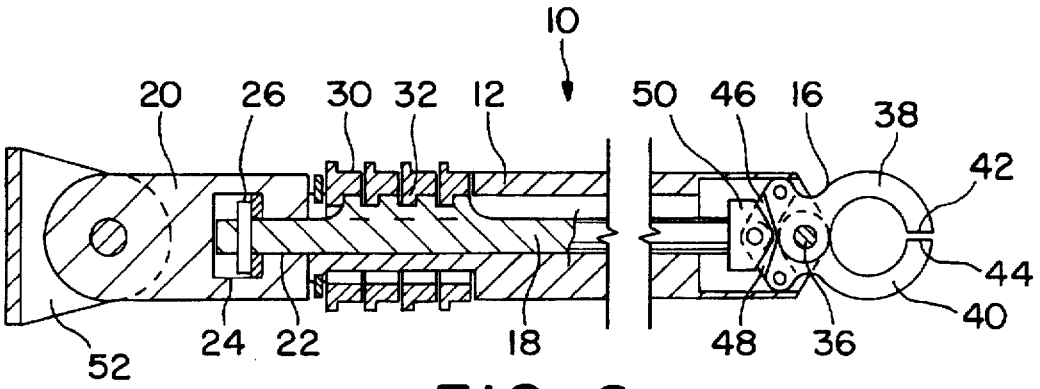
FIGS. 2 and 2A of the drawings are sectional views of an apparatus according to this invention locked in a completely closed position.
Figure 3:
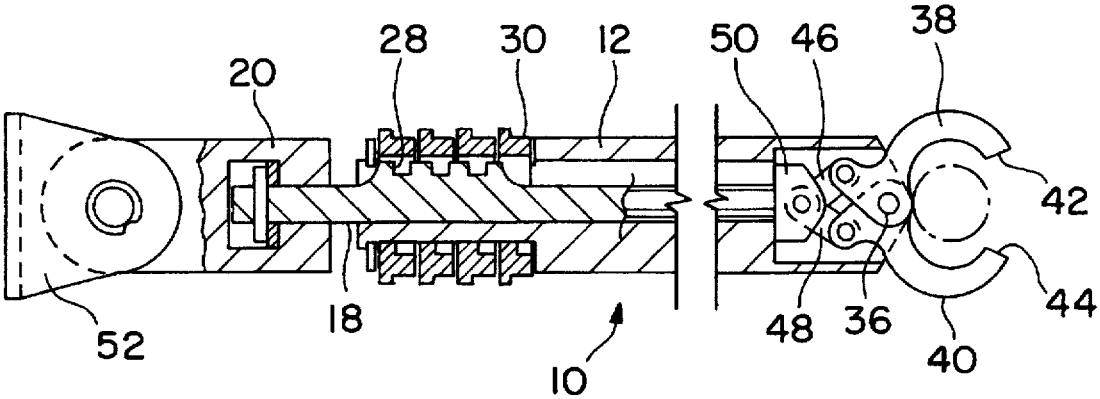
FIG. 3 of the drawings is a sectional view of an apparatus according to this invention in an unlocked position with the clamping member open.

A sectional view of grasping apparatus 10 is illustrated in FIG. 2 of the drawings. Shaft 18 can be seen and is positioned along the central axis of locking apparatus 10. Clamping member 16 is pivotally connected to shaft 18 at one end thereof. The other end of shaft 18 is preferably movably attached to a base 20 to hold the shaft in position while allowing rotation about its central axis. Such connection of the shaft to the base is illustrated in FIGS. 2 and 3 by the base defining an opening 22 therein which has an expanded area 24 and this connection allows rotation of the shaft, and the clamping member and sleeve can therefore be rotatable as well. The end of the shaft passes through opening 22 and into expanded area 24 where it is retained such as by affixing washer 26 securely around the end of the shaft. The shaft can also be fixedly attached to base 20 so that limited rotation or no rotation or movement of the shaft can occur. For adapting the grasping apparatus to be versatile in use, base 20 can be flexible or even telescopic as long as it holds the shaft in place.

Sleeve 12 is illustrated in FIG. 2 as fitted over that portion of shaft 18 outside of base 20. Sleeve 12 defines an axial passage through which the shaft passes. This view better illustrates how combination lock 14 is attached to the sleeve and surrounds the shaft. As shown in FIGS. 2 and 3, the sleeve preferably surrounds the shaft even underneath the combination lock except where the combination engages the shaft, as discussed below. Although this is the preferred structure of the combination lock, it is envisioned that a lock capable of locking to the shaft but not surrounding the shaft could be used.

Combination lock 14 is designed to lock to shaft 18 so that the lock and the sleeve, which without being locked in position are both slidable along the shaft, are locked in position on the shaft and cannot slide along the shaft. In one embodiment where the locking member comprises a combination lock, shaft 18 defines a plurality of notches 28 therein, best illustrated in FIG. 3. Notches 28 are designed to each receive a portion of one of the plurality of locking elements 30. The combination lock is a conventional type wherein the locking elements each define a central opening therethrough and the locking elements are individually rotatable around the central openings. The locking elements have extended portions 32 which extend annularly toward the central openings and fit into notches 28 to lock the locking member, and sleeve which is joined thereto, into position on the shaft wherein the locking member and sleeve cannot slide on the shaft, as illustrated in FIG. 2 of the drawings. The extended portion 32 of each locking element 30 defines a gap therein of sufficient size to allow the locking member and sleeve to slide freely on the shaft when the gaps of each locking element are aligned, as illustrated in cross section in FIG. 3. Indices such as letters and numbers are scored onto the locking elements and an alignment pointer 34, as illustrated in FIG. 1, is used to place each locking element in the locked position where the locking member and the sleeve can be slid along the shaft away from the base to which the shaft is attached.

Figure 2A:
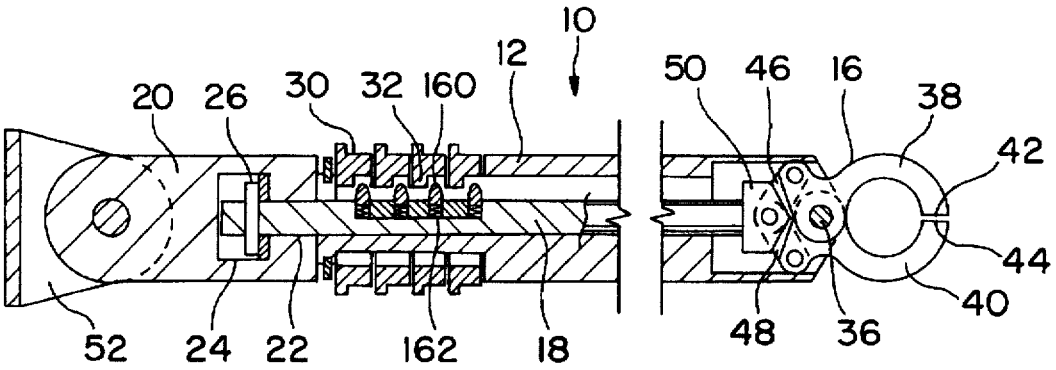

Alternatively, as best seen in reference to FIG. 2A, each locking element 30 can be engaged by a spring biased to floating pin 160, each pin and spring 162 being carried by a portion of shaft 18. When the pins engage the open void portion provided by the tumbler mechanism, the locking mechanism is free to move relative to the shaft. When the tumbler is in a locked position, the pins are engaged by the tumbler and locking is complete.

While the locking member in FIGS. 1–3 is shown as locking to the shaft near its end opposite the clamping member, the locking member according to this invention can be locked to the shaft at any point on the shaft over which the locking member is slidable. This ability of the locking member to be locked at various points along the shaft permits the clamping member to be locked in various positions ranging from fully open to fully closed since movement of the sleeve and locking member is linked to opening and closing of the clamping member as discussed below.

When the locking elements are not locked in position, the locking member and the sleeve can be slid along the shaft away from base 20. Since one end of the shaft is held within the base and the other end of the shaft is attached to the clamping member 16, sliding the sleeve in a direction away from base 20 causes the point of attachment of the clamping member and the sleeve, which is illustrated in the drawings as bolt 36, to extend in the same direction. As discussed below, the structure and connection of the clamping member allows movement of the sleeve along the shaft to cause the clamping member to open and close.

Clamping member 16 is shown in FIGS. 1–4 as comprising a pair of pivotally attached clamping arms 38 and 40 which preferably each include a substantially semi-circular section with one end being a tip 42 and 44, respectively. The other end of the substantially semi-circular section of each clamping arm is where the clamping arms are pivotally attached to one another, and this end of each clamping arm also extends in a direction away from the opposing clamping arm to provide a place for attachment of extension arms 46 and 48 which are pivotally attached to clamping arms 38 and 40 respectively. The other ends of extension arms 46 and 48 are pivotally attached to shaft 18 at the end opposite base 20. A stop 50 is preferably attached to the end of the shaft and receives attachment of the extension arms instead of directly attaching the extension arms to the shaft. The stop provides a stop for preventing the sleeve from sliding too far along the shaft. The stop allows the sleeve to slide a predetermined distance sufficient to permit the clamping arms to fully open. It is envisioned that the stop can also be an integral part of the shaft with the shaft simply being enlarged on its end near the clamping member to form the stop.

The pivotal attachment of the clamping arms to one another, to the extension arms, and of the extension arms to the stop enables the clamping arms to be moved outwardly away from the stop which causes them to pivot at their point of attachment and causes their tips to move away from one another thereby opening the clamping member. The open portion of the clamping member is illustrated in FIG. 3 and it can be seen that clamping arms 38 and 40 are open with their tips 42 and 44, respectively, positioned a distance away from one another. An object can now pass therebetween so the clamping member can close around it. The extension arms are shown in FIG. 3 as extending so that their ends joined to the clamping arms come closer together, as do the points of attachment of the clamping arms to the extension arms.

The closed position of the clamping member is illustrated in FIG. 2 as it shows the clamping arms closed with their tips 42 and 44 close together or even contacting one another. The ends of the extension arms 46 and 48 not attached to the shaft are extended further away from one another than when in the open position, and the point of attachment of the clamping arms to one another and to the sleeve, which is illustrated as bolt 36, is closer to stop 50 and shaft 18. By coming together in this closed position, the clamping arms define an annular opening therebetween as shown in FIG. 2. It is envisioned that the structure of the clamping arms can be of various other designs while allowing various shaped openings to be defined by the clamping arms when they are shown in a closed position.

Understanding the structural connection of the clamping arms to the shaft as described above and shown in FIGS. 2 and 3, the movement and coordination of the sleeve relative to the shaft therefore controls the opening and closing of the clamping arms. As illustrated in FIG. 2, when the locking member is positioned on the shaft adjacent the base with the locking elements over that part of the shaft which receives extended portions of the locking elements, the clamping arms are in the closed position. When the locking member is locked to the shaft as shown in FIG. 2, the clamping arms are thereby locked closed.

To open the clamping arms from the closed and locked position, the locking member must be unlocked from the shaft and then the sleeve and locking member can be manually slid along the shaft away from the base, the base and shaft away from the clamping member, or a combination of such actions. This gradual sliding action moves the pivotal point of the attachment of the sleeve and both clamping arms, illustrated as bolt 36, which simultaneously extends extension arms 46 and 48 and opens the clamping arms so that their tips move gradually apart, as illustrated in FIG. 3. Sliding the locking member and sleeve in this manner can expose some of shaft 18 between base 20 and the locking member as shown in FIG. 3. The sleeve preferably slides directly against at least some portions of the shaft and once the sleeve reaches stop 50, it is prevented from further sliding and the clamping arms are open their fullest. As evident from FIGS. 2 and 3, the shaft is maintained in place by base 20 as the sleeve slides away, but it is also evident that the base can be pulled away, thereby pulling the shaft, while the sleeve is held in place or even pulled oppositely to open the clamping arms. As discussed above, the locking member according to this invention can be lockable to the shaft at any point on the shaft over which the locking member is slidable. This enables the clamping arms to be locked in various positions where the clamping arms are not fully closed. This feature is advantageous for locking or clamping the clamping arms to objects too large for the clamping arms to completely surround.

In this preferred embodiment, the sleeve defines an area in its end opposite the locking member of sufficient size to allow a portion of the clamping arms and stop 50 to be contained therein, as shown in FIGS. 2 and 3, so that these structural connections between the shaft and the clamping arms are hidden from most views, as shown in FIG. 1, even as the clamping arms open and close.

To help hold base 20 in place, an anchor plate 52 can be used and affixed to a stationary object such as a wall, although it is envisioned according to this invention that the base itself can be attached directly to a stationary object. Base 20 is preferably pivotally attached to anchor plate 52 to allow a pivotal movement, as shown in FIG. 1, of the apparatus for convenience in using the clamping arms to lock around an object. Anchor plate 52 can even be adapted to attach directly to objects such as bicycles, motorcycles, power tools, or even to the wall of a pick-up truck. Once the anchor plate is affixed to an object, the clamping arms can be used to lock around an object capable of fitting between the clamping arms to secure the object to whatever object the anchor plate is affixed. The anchor plate can even be attached to an object and the clamping arms used to lock around another portion of the same object as desired.

Figure 4:
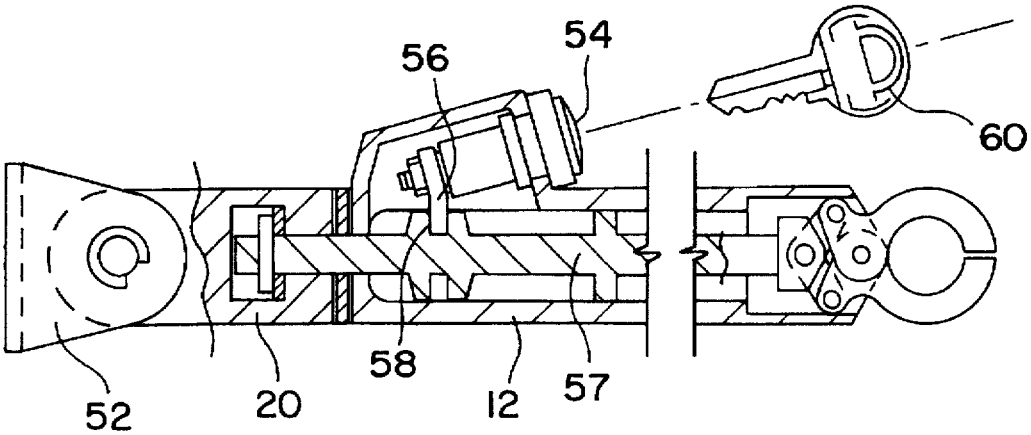
FIG. 4 of the drawings is a sectional view of an apparatus according to this invention wherein the locking member is a key-operated lock.

While it is preferred that the locking member of this invention be a combination lock, it is envisioned that other types of locks can be used as the locking member in the locking apparatus, such as key-operated locks or locks operated by electronic means. FIG. 4 of the drawings illustrates the apparatus according to the invention wherein the locking member is a key-operated lock. As shown in FIG. 4, a lock 54 is connected to sleeve 12 and is designed to rotate locking tab or arm 56. Shaft 57 is slightly modified from FIGS. 2 and 3 to accommodate the key-operated locking member as shaft 57 is shown as defining raised portions defining a notch 58 therebetween for receiving a portion of locking arm 56. Notch 58 preferably extends completely around shaft 57 so that the shaft can be rotated even while locking arm 56 engages the notch. Lock 54 is operable by a key, such as key 60, to rotate locking arm 56 in and out of position in notch 58. When the locking arm is positioned out of notch 58, the sleeve is therefore slidable away from base 20 to open the clamping members. When the locking arm is in place in notch 58, the sleeve is therefore locked in position and cannot slide along the shaft. It is also envisioned that a plurality of notches could be defined on the shaft so that the locking arm could be locked in one of various notches allowing for varying lockable positions for the clamping members.

Figure 5:
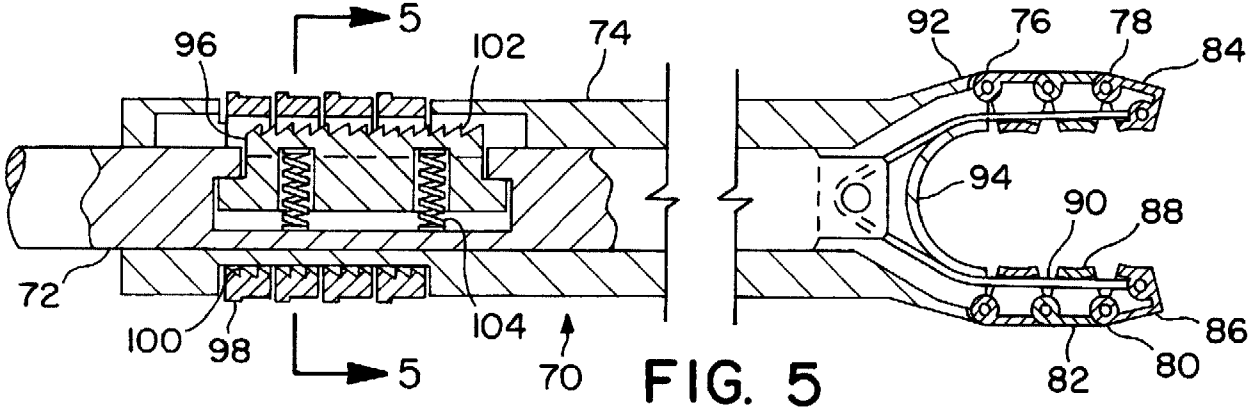
FIG. 5 of the drawings is a sectional view of an alternative embodiment of an apparatus according to this invention wherein the clamping member is open.
Figure 7:
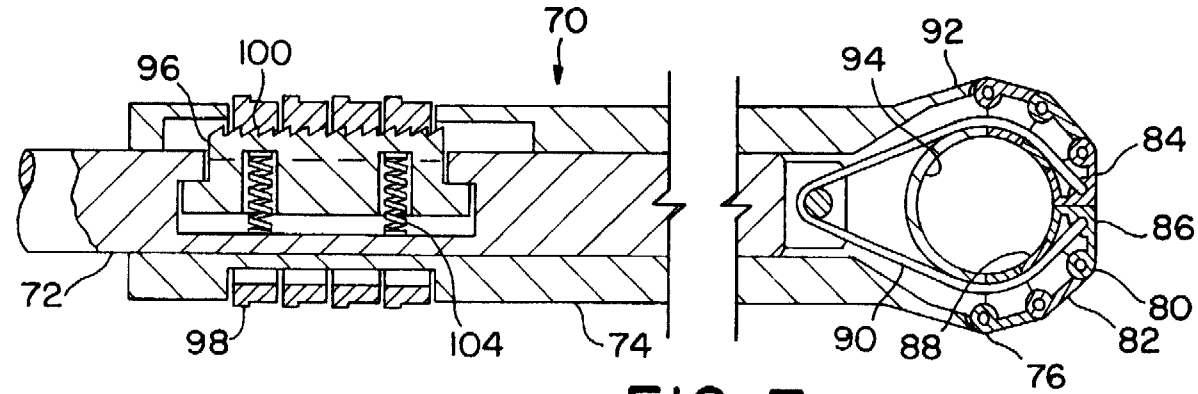
FIG. 7 of the drawings is a sectional view of an alternative embodiment of an apparatus according to the present invention with the clamping member completely closed.

While FIGS. 1–3 of the drawings show a grasping apparatus according to this invention with one embodiment of the clamping member, FIGS. 5 and 7 of the drawings illustrate a modified apparatus according to this invention including another embodiment of clamping member. Apparatus 70 as shown in FIGS. 5 and 7, much like apparatus 10 of FIGS. 1–3, includes a shaft 72 within a sleeve 74. Clamping member 76, however, comprises a pair of opposing, flexible clamping arms 78 and 80 which each include a plurality of clamping sections, such as clamping section 82, and terminate in a terminal clamping section 84 and 86, respectively. Clamping arm 78 and 80 are shown with three clamping sections but various numbers and sizes of clamping sections could be used. The clamping sections are preferably constructed so that they are pivotally and consecutively joined but spaced apart on the inner side of each clamping arm when open to allow the clamping arms to close inward for grasping or encircling an object. Each clamping section also preferably includes a gripping surface such as gripping surface 88 which can be used for gripping an object grasped by apparatus 70.

A pulling member shown as cord 90 runs or passes through the clamping sections and is anchored in one of the clamping sections of each clamping member, preferably in terminal gripping sections 84 and 86. Cord 90 is attached to shaft 72 so that movement of the shaft away from the clamping member or vice versa increases tension in the cord and pulls the clamping sections and therefore clamping arms 78 and 80 slightly downward and toward one another. When such movement is continued, the clamping arms ultimately reach the position as shown in FIG. 7 wherein the clamping member is completely closed with the terminal clamping sections contacting one another. It is preferred that cord 90 be a continuous cord that merely wraps around a portion of the shaft as shown in the drawings since this facilitates more even movement of the clamping arms, however it is envisioned that the cord could be fixedly attached to the shaft. Movement of the shaft toward the clamping member relaxes tension on the cord and allows the clamping arms to open as shown in FIG. 5. Cord 90 can be constructed of various materials such as rubber, plastic, cloth, metal or even a highly cut-resistant material such as Kevlar®.

Clamping member 76 is positioned on an end of the sleeve and includes a portion 92 which is formed as an extension of the sleeve and through which cord 90 passes to contact the shaft. Portion 92 includes a gripping surface 94 which is preferably substantially semi-circular. The clamping section of each clamping arm which is opposite the terminal clamping section is pivotally attached to portion 92. When clamping member 76 is completely closed as shown in FIG. 7, gripping surface 94 of portion 92 and the gripping surfaces of the clamping sections of the clamping arms contact one another and define a substantially circular opening.

Figure 6:
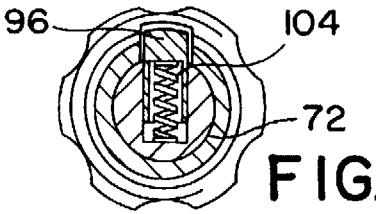
FIG. 6 of the drawings is a cross section along line 6—6 of FIG. 5.

Movement of shaft 72 within sleeve 74, movement of the sleeve on the shaft, or a combination of such movements therefore opens and closes clamping member 76. To facilitate slight movement of either action and to assist in locking the sleeve to the shaft in various positions, the shaft includes a lock receiving portion 96 for receiving portions of locking elements 98. Locking elements 98 are part of a combination locking member as in FIGS. 1–3 except preferably include a plurality of teeth 100 for engaging and mating with teeth 102 on lock receiving portion 96. Lock receiving portion 96 can be spring-loaded as shown in FIGS. 5, 6 and 7 where springs such as spring 104 are biased between the shaft and the lock receiving portion. This spring-loading of the lock receiving portion presses its teeth against those of the locking elements wherein they can matingly engage as shown in FIG. 7 to lock the sleeve in place on the shaft. FIG. 6 is a cross-sectional view showing spring 104 within shaft 72 biased between the lower portion of the shaft and lock receiving portion 96. When the teeth of the lock receiving portion and the locking elements are not engaged, as shown in FIG. 5, the sleeve is free to move along the shaft or the shaft within the sleeve.

It is preferred that teeth 102 be configured as in FIG. 5 with their points at the top right corners, so that a ratcheting type movement can occur between teeth 100 and teeth 102 wherein the sleeve is slidable along the shaft in the direction of clamping member 76 and the shaft is moveable within the sleeve away from the clamping member even when teeth 100 of the locking elements are engaging teeth 102 of the lock receiving portion. Such movement is important and advantageous since such movement closes clamping member 76 and allowing such movement to occur while the locking element is engaging the lock receiving portion does not release the clamping member but rather only allows the clamping member to be closed more. This feature is advantageous in that it permits the clamping member to be locked-even when only partially closed, and then tightened or closed further as desired without unlocking the locking elements.

An alternative construction of the locking mechanism uses a combination spring and floating pin arrangement carried by shaft 72 to engage the opposing locking mechanism, similar to the arrangement seen and described in reference to FIG. 2A. This type of locking mechanism does not provide the ratchet-type of multiple intermittent locked positions. Rather, a single locked position is provided for a terminal clamp 118.

Having a single locking position is useful for certain applications where a positive locking engagement may be used to ensure proper alignment of the clamp to the attachment. For instance, clamp 118 may be used to engage a ball of a trailer hitch. If so, a single locked position of clamp 118 may be designed to engage below the widest part of the ball hitch so that the clamp will not slip off the ball. For this type of application, the single locking position/clamp position operates as a safety mechanism to prevent the clamp from engaging in an unsafe position.

Figures 8, 9, 10:
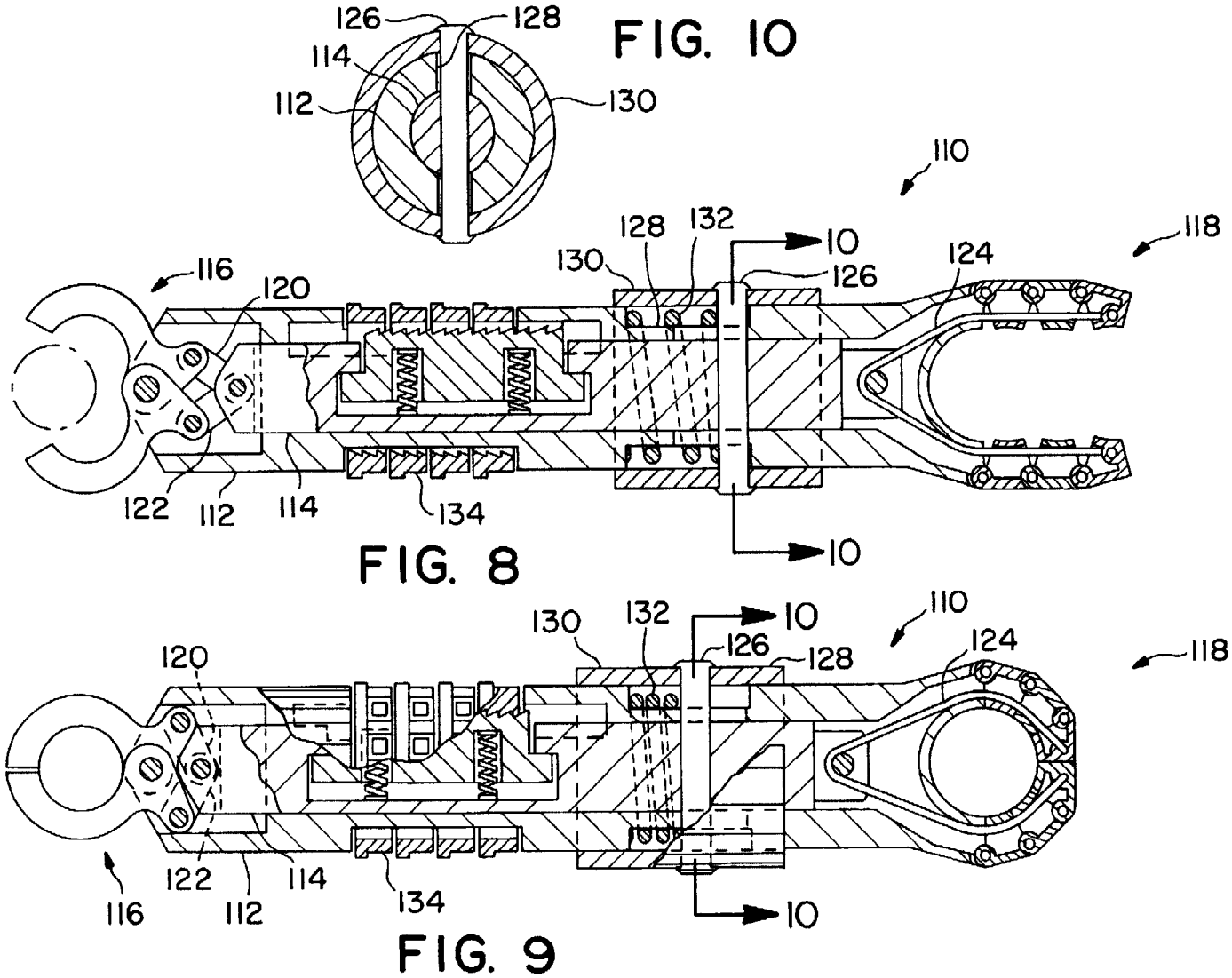
FIG. 8 of the drawings is a sectional view of an alternative embodiment of an apparatus according to this invention.
FIG. 9 of the drawings is a sectional view of an alternative embodiment of an apparatus according to this invention.
FIG. 10 of the drawings is a cross-section view drawn along line 10—10 of FIGS. 8 and 9.

FIGS. 8–10 of the drawings illustrate an embodiment of the grasping apparatus according to this invention wherein both embodiments of the clamping member discussed previously are included. As shown, grasping apparatus 110 comprises sleeve 112 slidably fitted on shaft 114. Clamping member 116 is attached to sleeve 112 and shaft 114 at one end of the sleeve and shaft, and clamping member 118 is attached to sleeve 112 at an opposite end of the shaft and sleeve from clamping member 116. Clamping member 116 is the same as that taught with reference to FIGS. 1–4, and clamping member 118 is that taught with reference to FIGS. 5–7. The discussions above with reference to the clamping members taught in FIGS. 1–4 and 5–7 are incorporated by reference herein. Clamping member 116 is thus pivotally attached to shaft 114 by extension arms here designated as 120 and 122. Clamping member 118 is this connected to shaft 114 by a pulling member, here designated as cord 124.

Placement of shaft 114 within sleeve 112 therefore opens and closes each clamping member. Movement of the shaft away from clamping member 116 and toward clamping member 118 opens each clamping member, and movement of the shaft in the opposite direction, toward clamping member 116 and away from clamping member 118, closes both clamping members. The connection of each clamping member to the shaft permit movement of the shaft to open or close, depending on the direction of movement each clamping member, simultaneously. The connections of each clamping member to the shaft are preferably such that each clamping member is fully closed at the same time.

To actuate and facilitate movement of shaft 114 within sleeve 112, a pin 126 is preferably used. FIGS. 8 and 9 show pin 126 and FIG. 10 illustrates pin 126 in a cross-section view drawn along line 10—10 of FIGS. 8 and 9. As shown, pin 126 is fixedly positioned through shaft 114 so that movement of pin 126 toward one or the other of the clamping members moves the shaft within the sleeve. Sleeve 112 defines an opening or slot 128 through which pin 126 passes which allows pin 126 to move within the slot without causing the sleeve to move. A collar 130 is preferably positioned around a portion of the sleeve to cover slot 128. Pin 126 passes through collar 130, being fixedly attached thereto as shown in the drawings. This structure of apparatus 110 permits collar 130 to be slidably moved along the sleeve to move pin 126 and shaft 114 to open and close the clamping members. Also envisioned is a collar than can be rotated to activate necessary linear movement of shaft 114 by use of a conventional worm gear and pinion or other well-known linkages for translating a rotational movement to a linear movement.

A spring 132 can be placed around sleeve 112 in a portion of slot 128 between an end of the slot closest to clamping member 116 and pin 126. Spring 132 thus biases pin 126 toward clamping member 118. In this manner, the pin is spring-loaded to maintain the clamping members in an open position, wherein closing them partially or fully requires at least some compression of spring 132 as shown in FIG. 9.

Apparatus 110, like apparatus 70 shown in FIGS. 5–7, includes a locking member for locking the clamping members in an open, closed, or partially closed position. In apparatus 110, the locking member locks the sleeve and the shaft so that the shaft, which is typically hidden from view, cannot slidably move within the sleeve. The locking member illustrated in FIGS. 8 and 9 is the same as that taught herein with reference to FIGS. 5–7, and such previous discussion is incorporated by reference with respect to apparatus 110. Use of such a locking member on apparatus 110 as shown in FIGS. 8 and 9 thus allows both clamping members to be locked in an open, closed, or partially closed position since the locking member prevents movement of the shaft within the sleeve. It is envisioned, however, that other types of locking members could also be utilized with apparatus 110, such as a key-operated lock.

Utilization of apparatus 110 can therefore be accomplished by making sure the locking member is not engaged, placing each clamping member completely or partially around an object, and sliding the collar and pin, which are biased toward clamping member 118, in the direction of clamping member 116 to gradually and simultaneously close each clamping member. When the clamping members are closed to a desired position, the locking elements, designated in FIGS. 8 and 9 as 134, are then related to engage and lock the shaft so that it cannot slide within the sleeve.

It is therefore seen that a novel grasping apparatus and method is provided according to this invention which can be used to grasp a variety of apparatuses and secure them to themselves or to other objects.

It is also seen that a grasping apparatus and method is provided which is simple and convenient to use and which does not require the use of chains or cables.

It is further seen that the grasping apparatus can be fixed or secured to stationary or base objects such as walls whereby objects can be locked by the grasping apparatus to the stationary objects.

For military applications, present grasping and locking apparatus can be constructed with tamper proof ordinances such that exposure to high heat, such as an acetelyne torch, or high pressure, such as hydraulic operated cutters, would detonate the mechanism.

The present invention lends itself to multiple uses in a variety of different work environments. The ability of a push or a pull action on the shaft to open or close a remote terminal clamp has uses in medical and surgical instrumentation. Further, the present invention has uses in law enforcement where a clamping, lockable member may be carried on the terminous of a long shaft. The device can be used to safely restrain a violent or aggressive individual's arm or leg from a safe distance without risking injury to personnel. Once restrained, the individual can be approached more safely for traditional restraints.

The clamping mechanism according to this invention has been shown to operate using either a push action relative to a base, a pulling action, or using a rotational action which is translated to the respective linear movement. For the purposes of illustration, the figures and embodiments shown in this invention which illustrates dual clamping apparatuses illustrate clamps which operate in opposing directions. It is envisioned that a dual clamping apparatus can be provided in which both clamping ends are identical with respect to opening or closing movement of the shaft relative to the clamp.

As various modifications will become apparent to those of skill in the art from a reading of the above description, such modifications are embodied within the spirit and scope of this invention as measured by the following appended claims.

That which is claimed is:

1. A grasping apparatus comprising:

a sleeve having opposing ends;

a shaft within and movable relative to the sleeve;

a pair of clamping members for opening and closing on each opposing end of the sleeve, wherein one of the clamping members comprises a pair of clamping arms pivotally attached to the shaft, the other clamping member comprises a pair of opposing, flexible clamping arms each including a plurality of clamping sections, and a pulling member connected to the shaft and at least one of the clamping sections of each clamping arm;

whereby slidable movement of the sleeve along the shaft in one direction opens both clamping members and slidable movement of the sleeve along the shaft in an opposite direction closes both clamping members.

2. The apparatus according to claim 1 further including a locking member on the sleeve for locking the sleeve in position on the shaft.

3. The apparatus according to claim 1 further comprising a locking member for locking the sleeve in position on the shaft and therefore locking the clamping members in position.

4. The apparatus according to claim 1 wherein the sleeve defines a slot and further including a pin fixedly positioned through the shaft and passing through the slot in the sleeve.

5. The apparatus according to claim 4 further including a spring positioned in the slot of the sleeve biasing the pin.

6. The apparatus according to claim 4 further including a collar around a portion of the sleeve in the slot and wherein the pin fixedly passes through the collar.

7. A grasping apparatus comprising:

a sleeve;

a shaft within and movable relative to the sleeve, the shaft having a plurality of teeth;

a clamping member on one end of the sleeve for opening and closing, said clamping member comprising:

a pair of opposing, flexible clamping arms, each clamping arm including a plurality of clamping sections pivotally and consecutively joined, each clamping arm terminating in a terminal clamping section; and a pulling member positioned within the clamping member, the pulling member being anchored in the terminal clamping section of each clamping arm and attached to the shaft whereby movement of the shaft toward the clamping member allows the clamping member to open, and movement of the shaft away from the clamping member causes the pulling member to pull the clamping member to close as the terminal clamping sections of each clamping arm are pulled closer together, whereby slidable movement between the sleeve and the shaft both opens and closes the clamping member; and a locking member on the sleeve for locking the sleeve to the shaft, the locking member comprising a plurality of rotatable locking elements, portions of said locking elements receivable in the plurality of teeth on said shaft, whereby the clamping member can be locked in an open, closed, or partially closed position.

8. The apparatus according to claim 7 wherein the clamping member is unitary with and extends from the sleeve.

9. The apparatus according to claim 7 wherein each clamping section includes an inner gripping surface, the gripping surfaces being spaced apart when the clamping member is open and together when the clamping member is completely closed.

10. The apparatus according to claim, 9 wherein the gripping surfaces substantially form a semi-circle when the clamping member is completely closed.

11. The apparatus according to claim 10 wherein the clamping arms are pivotally connected to an extension of the sleeve which includes a substantially semi-circular gripping surface whereby a substantially circular opening is formed when the clamping member is closed.

12. The apparatus according to claim 7 wherein the shaft includes a lock receiving portion which defines the plurality of teeth for receiving portions of the locking elements.

13. The apparatus according to claim 12 wherein the lock receiving portion is spring-loaded.

14. The apparatus according to claim 7 wherein the locking elements define center openings through which the shaft passes.

15. A grasping apparatus comprising:

a sleeve;

a shaft within and movable relative to the sleeve, said shaft having a plurality of notches;

a clamping member pivotally attached to the sleeve for opening and closing, the clamping member comprising:

a pair of pivotal clamping arms, an extension arm pivotally attached to a respective clamping arm, the extension arms pivotally attached to the shaft, whereby slidable movement between the sleeve and the shaft both opens and closes the clamping member; and a locking member on the sleeve, the locking member comprising a plurality of rotatable locking elements receivable in said notches in said shaft.

16. The apparatus according to claim 15 wherein the clamping arms define an annular opening therebetween when the clamping member is in a closed position.

17. The apparatus according to claim 15 wherein the sleeve is cylindrical.

18. The apparatus according to claim 15 wherein an end of the shaft opposite the clamping member is rotatably attached to a base.

19. The apparatus according to claim 18 wherein the shaft is substantially concealed by the base, the locking member, and the sleeve when the clamping member is in a closed position.

20. The apparatus according to claim 15 wherein the locking elements define center openings through which the shaft passes.

21. The apparatus according to claim 15 wherein the clamping member is attached to the shaft through an axial opening defined through the sleeve.

22. The apparatus according to claim 15 further including a stop on the end of the shaft and wherein the clamping member is pivotally attached to the stop, the stop positioned so as to prevent the sleeve from sliding more than a predetermined distance on the shaft.

23. A grasping apparatus comprising:

a base;

a sleeve;

a shaft within and movable relative to the sleeve, said shaft having a notch, said shaft rotatably attached to said base at an end;

a clamping member pivotally attached to the sleeve for opening and closing, the clamping member comprising:
a pair of pivotal clamping arms,
an extension arm pivotally attached to a respective clamping arm, the extension arms pivotally attached to the shaft at an opposite end, whereby slidable movement between the sleeve and the shaft opens and closes the clamping member; and a locking member on said sleeve, said locking member comprising a key-operated lock, a portion of said lock receivable in said notch in said shaft;

wherein said shaft is substantially concealed by said base, said locking member, and said sleeve when the clamping member is in a closed position.

24. The apparatus according to claim 23 wherein the clamping arms define an annular opening therebetween when the clamping member is in a closed position.

25. The apparatus according to claim 23 wherein the sleeve is cylindrical.

26. The apparatus according to claim 23 wherein the clamping member is attached to the shaft through an axial opening defined through the sleeve.

27. The apparatus according to claim 23 further including a stop on the end of the shaft and wherein the clamping member is pivotally attached to the stop, the stop positioned so as to prevent the sleeve from sliding more than a predetermined distance on the shaft.

28. A grasping apparatus comprising:

a sleeve;

a shaft within and movable relative to the sleeve, said shaft having a notch;

a clamping member pivotally attached to the sleeve for opening and closing, the clamping member comprising:
a pair of pivotal clamping arms,
an extension arm pivotally attached to a respective clamping arm, the extension arms pivotally attached to the shaft, whereby slidable movement between the sleeve and the shaft opens and closes the clamping member; and a base, said clamping member pivotally attached to said base.

29. The apparatus according to claim 28 wherein the clamping arms define an annular opening therebetween when the clamping member is in a closed position.

30. The apparatus according to claim 28 herein the sleeve is cylindrical.

31. The apparatus according to claim 28 wherein the shaft is substantially concealed by the base and the sleeve when the clamping member is in a closed position.

32. The apparatus according to claim 28 wherein the clamping member is attached to the shaft through an axial opening defined through the sleeve.

33. The apparatus according to claim 28 further including a stop on the end of the shaft and wherein the clamping member is pivotally attached to the stop, the stop positioned so as to prevent the sleeve from sliding more than a predetermined distance on the shaft.

* * * * *